US009782622B2

(12) United States Patent
Hornback

(10) Patent No.: US 9,782,622 B2
(45) Date of Patent: Oct. 10, 2017

(54) EXERCISE APPARATUS

(71) Applicant: Jerome B. Hornback, Geenwood, IN (US)

(72) Inventor: Jerome B. Hornback, Geenwood, IN (US)

(73) Assignee: Team X, LLC, Greenwood, IN (US)

( * ) Notice: Subject to any disclaimer, the term of this patent is extended or adjusted under 35 U.S.C. 154(b) by 50 days.

(21) Appl. No.: 14/976,840

(22) Filed: Dec. 21, 2015

(65) Prior Publication Data

US 2016/0184629 A1 Jun. 30, 2016

Related U.S. Application Data

(60) Provisional application No. 62/097,624, filed on Dec. 30, 2014.

(51) Int. Cl.

| | |
|---|---|
| ***A63B 23/02*** | (2006.01) |
| ***A63B 23/04*** | (2006.01) |
| ***A63B 21/04*** | (2006.01) |
| ***A63B 21/055*** | (2006.01) |
| ***A63B 21/068*** | (2006.01) |
| *A63B 21/06* | (2006.01) |
| *A63B 21/00* | (2006.01) |
| *A63B 41/00* | (2006.01) |

(52) U.S. Cl.

CPC .... *A63B 23/0482* (2013.01); *A63B 21/00065* (2013.01); *A63B 21/0442* (2013.01); *A63B 21/0552* (2013.01); *A63B 21/068* (2013.01); *A63B 21/4033* (2015.10); *A63B 21/4034* (2015.10); *A63B 23/0205* (2013.01); *A63B 21/00061* (2013.01); *A63B 21/00069* (2013.01); *A63B 21/06* (2013.01); *A63B 21/4009* (2015.10); *A63B 21/4035* (2015.10); *A63B 23/0211* (2013.01); *A63B 23/0216* (2013.01); *A63B 23/0222* (2013.01); *A63B 41/00* (2013.01); *A63B 2209/08* (2013.01); *A63B 2209/10* (2013.01)

(58) Field of Classification Search

CPC ..... A63B 23/0482; A63B 21/4033; A63B 21/4034; A63B 21/00065; A63B 21/0442; A63B 21/0552; A63B 21/068; A63B 23/0205; A63B 23/02

USPC ..... 482/98, 123, 133, 140

See application file for complete search history.

(56) References Cited

U.S. PATENT DOCUMENTS

| | | | | |
|---|---|---|---|---|
| 3,130,968 | A | | 4/1964 | De Feen |
| 4,176,836 | A | * | 12/1979 | Coyle ..... A63B 21/0622 482/96 |
| 4,200,279 | A | | 4/1980 | Lambert |
| 4,226,415 | A | | 10/1980 | Wright |
| 4,398,713 | A | | 8/1983 | Ellis et al. |
| 4,405,128 | A | | 9/1983 | McLaughlin |
| 4,753,438 | A | | 6/1988 | Paris et al. |
| 4,763,897 | A | | 8/1988 | Yakata |
| 4,854,578 | A | | 8/1989 | Fulks |

(Continued)

*Primary Examiner* — Andrew S Lo

(74) *Attorney, Agent, or Firm* — Barnes & Thornburg LLP

(57) ABSTRACT

An exercise apparatus or machine according to the present disclosure is adapted to support a user above a floor while the user performs hip thrust or other exercises. The exercise machine includes a head support and a foot support for supporting the torso and feet of a user so that the hips of the user are suspended in an exercise area between the head support and foot support.

19 Claims, 12 Drawing Sheets

(56) References Cited

U.S. PATENT DOCUMENTS

| | | | | |
|---|---|---|---|---|
| 4,893,812 | A | 1/1990 | Dawson et al. | |
| 4,902,008 | A | 2/1990 | Jones | |
| 5,031,905 | A | 7/1991 | Walsh | |
| 5,042,800 | A | 8/1991 | Walter | |
| 5,125,459 | A | 6/1992 | Richards | |
| 5,147,259 | A | 9/1992 | Hutchins | |
| 5,147,267 | A | 9/1992 | Kunewalder | |
| 5,221,246 | A | 6/1993 | Torii et al. | |
| 5,256,126 | A | 10/1993 | Grotstein et al. | |
| 5,306,220 | A | 4/1994 | Kearney et al. | |
| 5,330,408 | A | 7/1994 | Westmoreland | |
| 5,433,220 | A | 7/1995 | Kostich | |
| 5,551,934 | A | 9/1996 | Binette | |
| 5,681,250 | A | 10/1997 | Hoover et al. | |
| 5,913,759 | A | 6/1999 | Bostroem | |
| 5,935,050 | A | 8/1999 | Shahan | |
| 5,971,901 | A | 10/1999 | Shaw | |
| 5,971,902 | A | 10/1999 | Robertson et al. | |
| 6,168,557 | B1 | 1/2001 | Liao | |
| 6,206,809 | B1 | 3/2001 | Habing et al. | |
| 6,220,994 | B1 | 4/2001 | Rich | |
| 6,280,367 | B1 | 8/2001 | Arsenault | |
| 6,299,569 | B1 | 10/2001 | Rich | |
| 6,319,180 | B1 | 11/2001 | Kallassy | |
| 6,387,024 | B1 | 5/2002 | Monti et al. | |
| 6,398,699 | B1 | 6/2002 | Yang | |
| 6,468,188 | B1 | 10/2002 | Koenig | |
| 6,692,418 | B2 | 2/2004 | Shahan | |
| 6,955,635 | B2 | 10/2005 | Chelekis | |
| 7,115,081 | B2 | 10/2006 | Stearns | |
| 7,125,371 | B2 | 10/2006 | Henderson | |
| 7,128,701 | B1 | 10/2006 | Ketcham | |
| 7,367,928 | B2 | 5/2008 | Storch | |
| 7,488,281 | B2 | 2/2009 | Weir et al. | |
| 7,637,851 | B1 | 12/2009 | Lormil | |
| 7,717,837 | B2 | 5/2010 | Florczak | |
| 7,935,038 | B2 | 5/2011 | Tyree | |
| 7,967,738 | B2 | 6/2011 | Dauterive | |
| 8,172,736 | B2 | 5/2012 | Contreras | |
| 8,465,403 | B2 * | 6/2013 | McCall, Jr. | A63B 23/0205 482/142 |
| D685,867 | S * | 7/2013 | Mehlman | D21/687 |
| 8,568,281 | B2 * | 10/2013 | Beaulieu | A63B 23/0458 482/142 |
| 8,926,483 | B1 * | 1/2015 | Holloway | A63B 26/003 297/271.5 |
| 8,986,179 | B2 | 3/2015 | Cares | |
| 9,180,329 | B2 * | 11/2015 | Doane | A63B 21/00047 |
| D763,371 | S * | 8/2016 | Fitzgerald | D21/686 |
| 2002/0151419 | A1 | 10/2002 | Barnes et al. | |
| 2002/0173412 | A1 | 11/2002 | Stearns | |
| 2002/0183171 | A1 | 12/2002 | Taylor et al. | |
| 2003/0060347 | A1 | 3/2003 | Tang | |
| 2004/0053757 | A1 | 3/2004 | Chung | |
| 2004/0209750 | A1 | 10/2004 | Parmater | |
| 2005/0143233 | A1 | 6/2005 | Shifferaw | |
| 2006/0100070 | A1 | 5/2006 | Abdo | |
| 2007/0207901 | A1 * | 9/2007 | Traub | A63B 26/003 482/52 |
| 2008/0064576 | A1 | 3/2008 | Tyree | |
| 2009/0098988 | A1 | 4/2009 | Kennedy | |
| 2009/0264265 | A1 * | 10/2009 | Contreras | A63B 21/00047 482/99 |
| 2010/0179038 | A1 | 7/2010 | Hahn | |
| 2010/0204027 | A1 | 8/2010 | Dauterive | |
| 2010/0248917 | A1 * | 9/2010 | Reyes | A63B 23/04 482/133 |
| 2011/0028290 | A1 * | 2/2011 | Ozawa | A63B 21/0085 482/142 |
| 2011/0124476 | A1 * | 5/2011 | Holley | A63B 23/02 482/121 |
| 2011/0190104 | A1 | 8/2011 | Derrick | |
| 2011/0218083 | A1 | 9/2011 | Staff | |
| 2012/0122638 | A1 | 5/2012 | Cares | |
| 2014/0066276 | A1 * | 3/2014 | Hornback | A63B 21/068 482/145 |

* cited by examiner

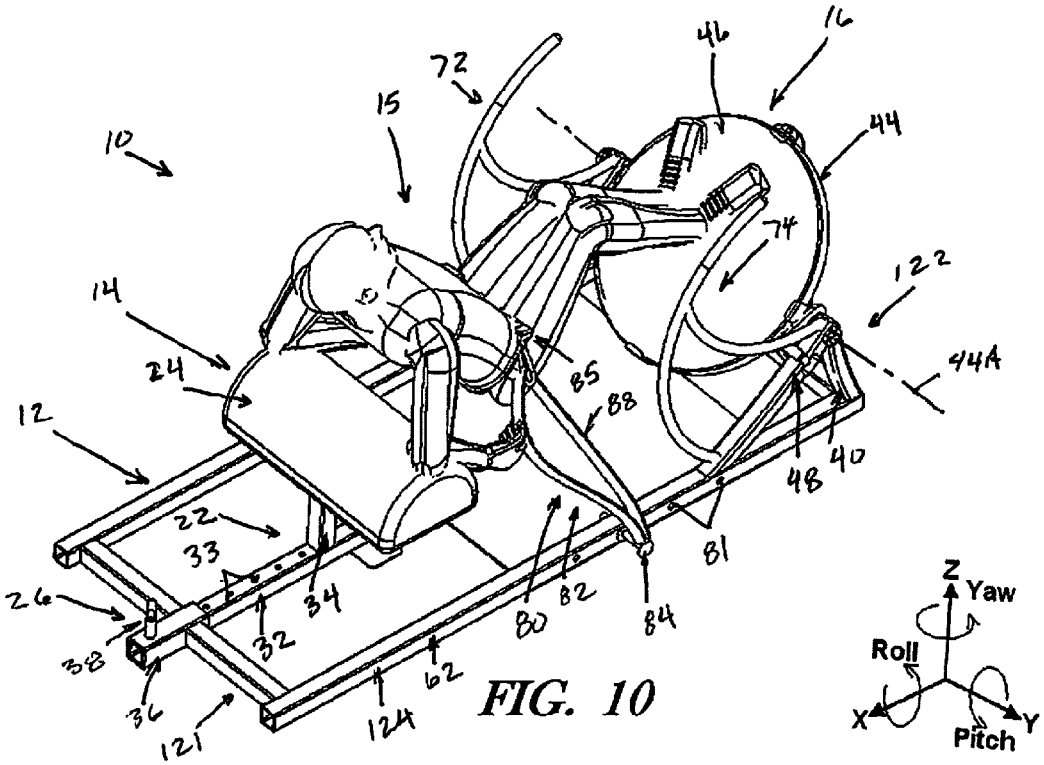
FIG. 10
FIG. 11
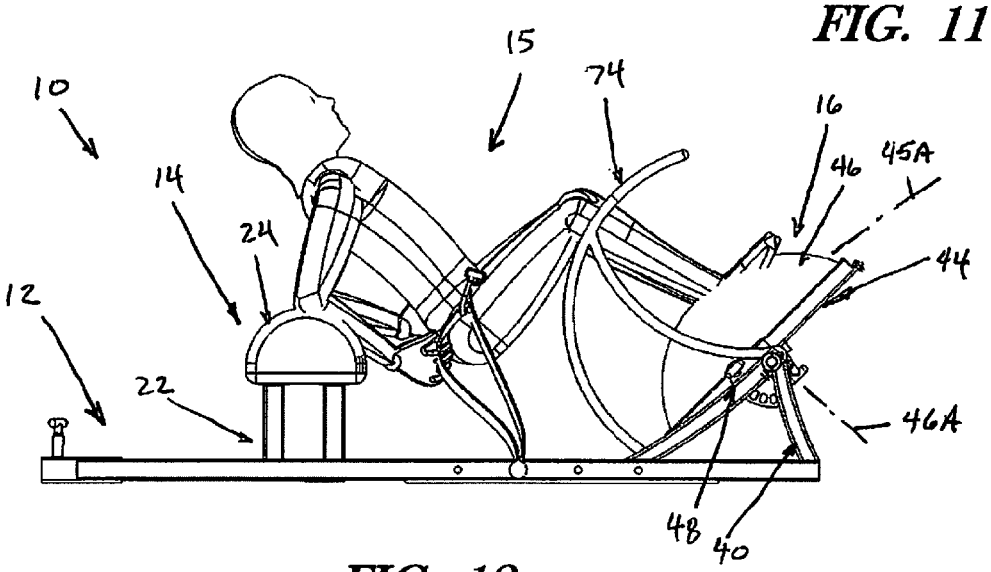
FIG. 12

EXERCISE APPARATUS

PRIORITY CLAIM

This application claims priority under 35 U.S.C. §119(e) to U.S. Provisional Application Ser. No. 62/097,624, filed Dec. 30, 2014, which is expressly incorporated by reference herein.

BACKGROUND

The present application is directed to exercise equipment; and, specifically to exercise equipment for exercising the legs of a user. More specifically, the present application is directed to an exercise apparatus or machine for performing hip thrust exercises.

SUMMARY

An exercise apparatus or machine according to the present disclosure is adapted to support a user above a floor while the user performs hip thrust or other exercises. The exercise machine includes a head support and a foot support for supporting the torso and feet of a user so that the hips of the user are suspended in an exercise area between the head support and foot support.

In illustrative embodiments, the foot support includes a curved dome that provides a foot engagement surface arranged to support the feet of the user. Such a curved engagement surface can encourage stabilizer muscles of the user to be engaged during exercise.

In illustrative embodiments, the foot support may be pivotable/rotatable in one or more axes. Such rotation can allow the foot support to be ergonomically positioned for different users and, if allowed to move during exercise, can encourage stabilizer muscles of the user to be engaged during exercise.

In illustrative embodiments, resistance mechanisms may be included in the exercise machine to increase the load on a user performing exercises. These resistance mechanisms may include resistance bands and/or hip bars that resist upward movement of a user's hips during a hip thrust exercise.

In illustrative embodiments, a user may use the exercise machine disclosed herein to perform an exercise method in which the users elbows engage the head support, the users feet engage the foot support, and the user's hips are raised to perform a hip thrust. Such a method may also include adjustment of various components of the exercise machine as further described herein.

Additional features of the present disclosure will become apparent to those skilled in the art upon consideration of illustrative embodiments exemplifying the best mode of carrying out the disclosure as presently perceived.

BRIEF DESCRIPTIONS OF THE DRAWINGS

The detailed description particularly refers to the accompanying figures in which:

FIG. 10 is a head end perspective view of the exercise machine of FIGS. 1-5 exercise machine showing a user exercising the muscle groups of the leg;

FIG. 11 is an illustration showing of the relative X-Y-Z axis with respect to the exercise machine axis FIG. 10;

FIG. 12 is a side elevation of the exercise machine of FIGS. 1-5 showing the user exercising;

DETAILED DESCRIPTION

Figure 1:
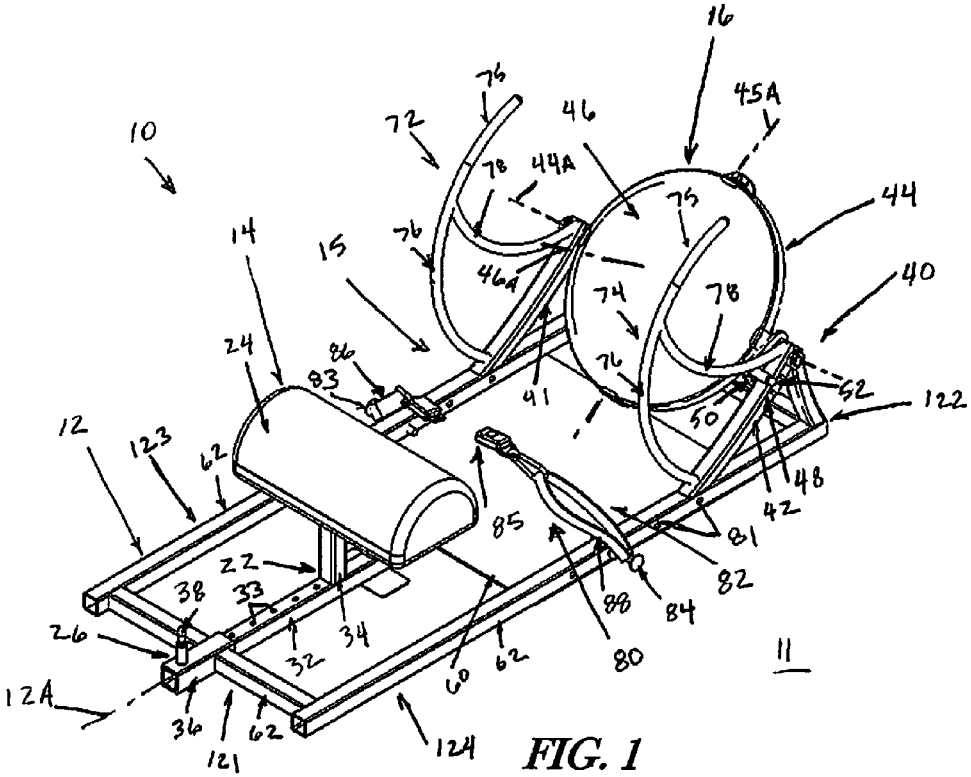
FIG. 1 is a head end perspective view of an exercise machine exercising muscles groups of the leg.

An exercise apparatus or machine 10 according to the present disclosure is adapted to support a user above a floor 11 while the user performs hip thrust or other exercises as suggested in FIGS. 1, 2, 10 and 12. Optional resistance mechanisms 80, 280 may be included in the exercise machine 10 if desired to increase the load on a user performing exercises on the exercise machine 10 as further described below.

The exercise machine 10 illustratively includes a base frame 12 adapted to engage the floor 11, a head support 14 adapted to support the torso of a user, and a foot support 16 adapted to support the feet of a user as shown in FIGS. 10 and 12. The head support 14 is coupled to a head end 121 of the base frame 12 and the foot support 16 is coupled to a foot end 122 of the base frame 12 so that an exercise space 15 is defined between the head support 14 and the foot support 16 that is sized to allow hips of a user to be moved from a lowered position within the exercise space 15 below the elbows and feet of the user to a raised position above the elbows and feet of the user to perform a hip thrust movement.

Figure 2:
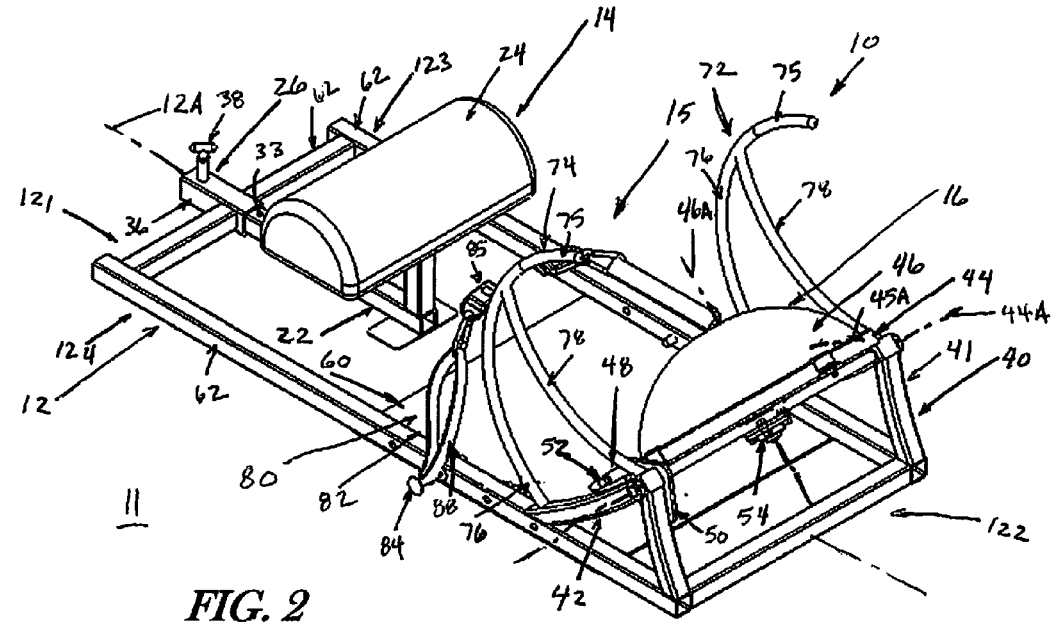
FIG. 2 is a foot end perspective view of the exercise machine of FIG. 1.
Figure 3:
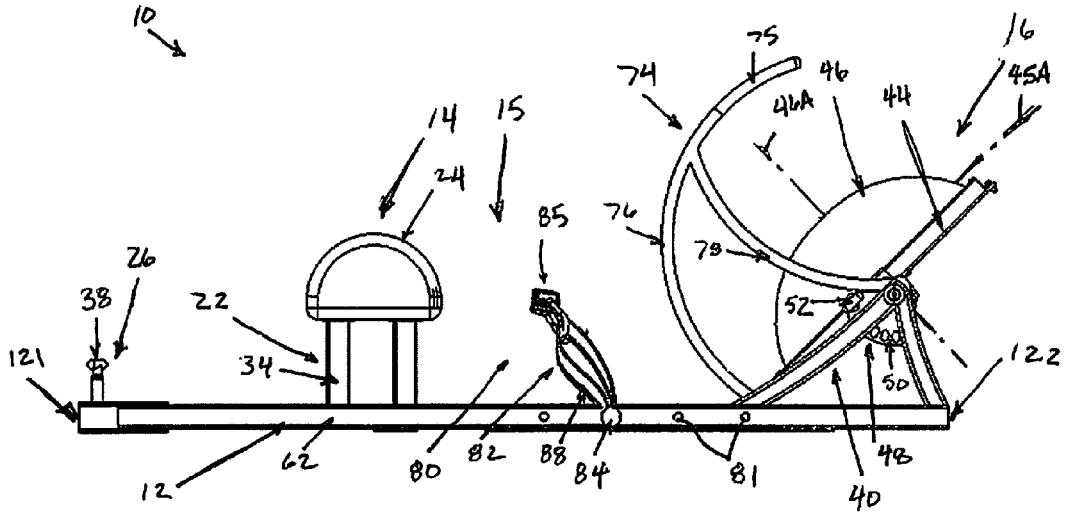
FIG. 3 is a side elevation view of the exercise machine of FIGS. 1 and 2.
Figure 4:
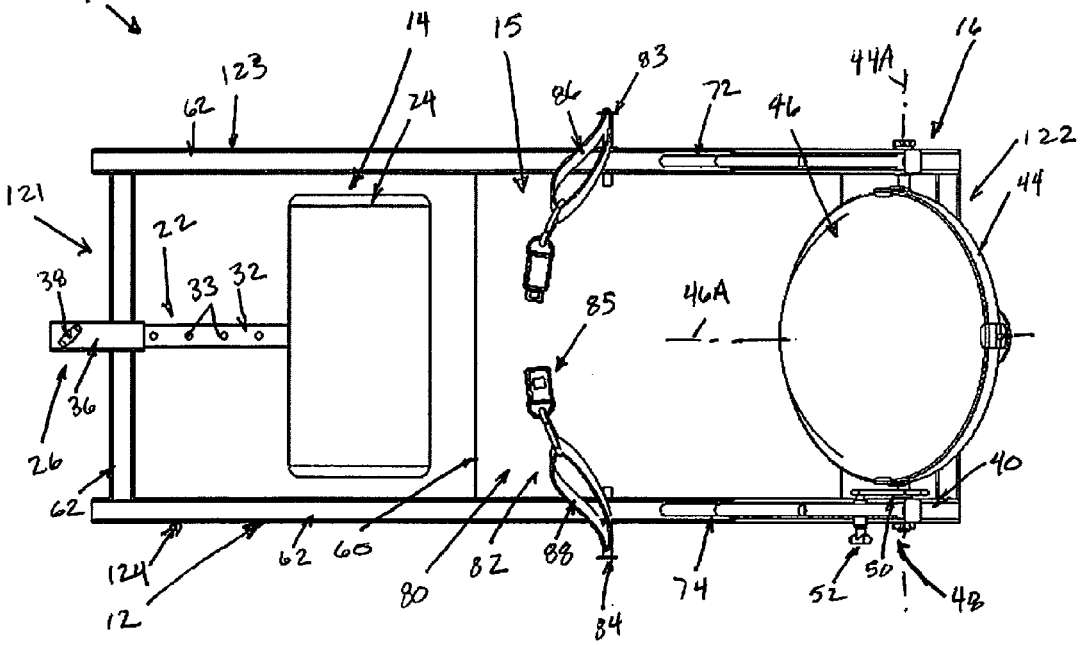
FIG. 4 is a top plan view of the exercise machine of FIGS. 1-3.

The head support 14 is illustratively coupled to the head end 121 of the base frame 12 to slide toward and away from the foot end 122 of the base frame 12 to accommodate users of different sizes as suggested in FIGS. 1 and 2. The head support 14 illustratively includes a riser 22 that extends upwardly from the base frame 12, a head pad 24 adapted to support a user, and a slide lock 26 that selectively blocks or allows movement of the head support 14 relative to the base frame 12. The riser 22 is illustratively L-shaped and has a horizontally extending leg 32 formed to include a plurality of holes 33 and a vertically extending leg 34. The head pad 24 is coupled to the vertically extending leg 34 of the riser 22 and is adapted to support the torso of a user, illustratively through the elbows of the user. The slide lock 26 illustratively includes a receiver 36 sized to receive the horizontally extending leg 32 of the riser 22 and a pin 38 that moves into and out of the receiver 36. The pin 38 moves from a locked position extending into the receiver 36 and into one of the holes 33 in the riser 22 blocking movement of the riser 22 and pad 24 to an unlocked position removed from the holes 33 in the riser 22 allowing movement of the riser 22 and pad 24.

The foot support 16 is illustratively coupled to the foot end 122 of the base frame and is movable to support the feet of a user in various positions as suggested in FIGS. 1-5. The foot support 16 of the exemplary embodiment includes a mount bracket 40 that extends up from the base frame 12, a support plate 44 coupled to the mount bracket 40, and a foot engagement member 46 adapted to be engaged by the feet of a user. The mount bracket 40 illustratively includes left and right risers 41, 42 that extend upwardly along left and right sides 123, 124 of the base frame 12. The support plate 44 is coupled to and extends between the risers 41, 42 of the mount bracket 40. The engagement member 46 is coupled to the support plate 44 and provides a foot engagement surface 45 sized to be engaged by two feet of a user supported on the exercise machine 10.

In the illustrative embodiment, the support plate 44, along with the engagement member 46, of the foot support 16 are coupled to the mount bracket 40 to pivot about a pivot axis 44A as shown in FIGS. 1 and 2. The pivot axis 44A or Y-axis extends perpendicular to an axis 12A of the base frame that extends from the head end 121 to the foot end 122 of the base frame 12. In this embodiment, the foot support 16 includes a pivot lock 48 configured to selectively block or allow movement of the support plate 44 and the engagement member 46 of the foot support 16 about the pivot axis 44A. The pivot lock 48 illustratively includes a lock plate 50 and a lock pin 52. The lock plate 50 is coupled to the support plate 44 for movement about the pivot axis 444A and is formed to include a plurality of holes 51. The lock pin 52 is coupled to the bracket 40 and is movable from a locked position engaging one of the holes 51 blocking movement of the support plate 44 to an unlocked position removed from the holes 51 allowing movement of the support plate 40.

Figure 7:
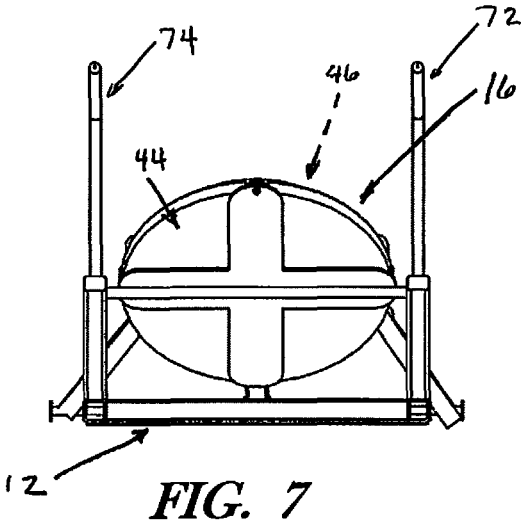
FIG. 7 is a foot end elevation of the exercise machine of FIGS. 1-3 with yet another alternative foot support having a rotational device.
Figure 8:
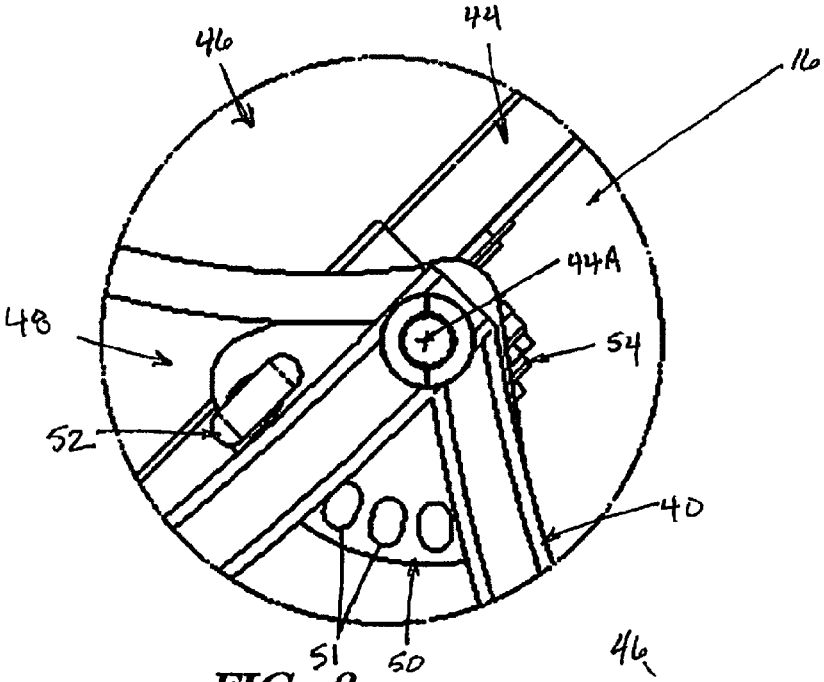
FIG. 8 is a detail view of a portion of FIG. 3.
Figure 9:
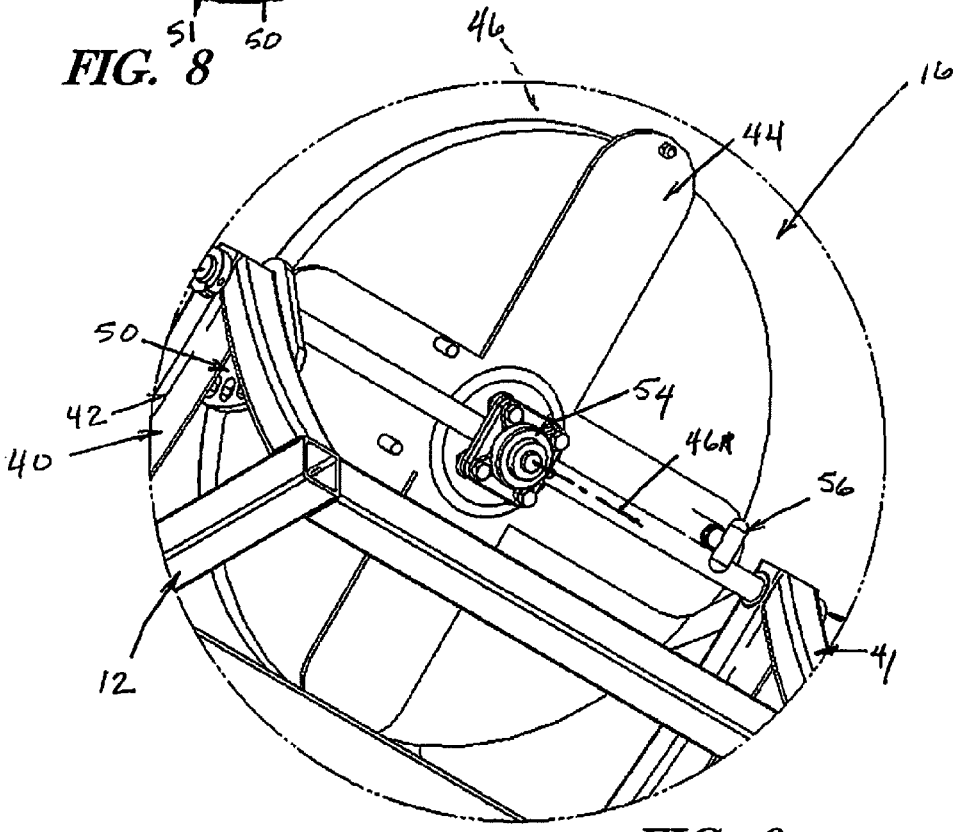
FIG. 9 is a detail view of a portion of FIG. 5.
Figure 13:
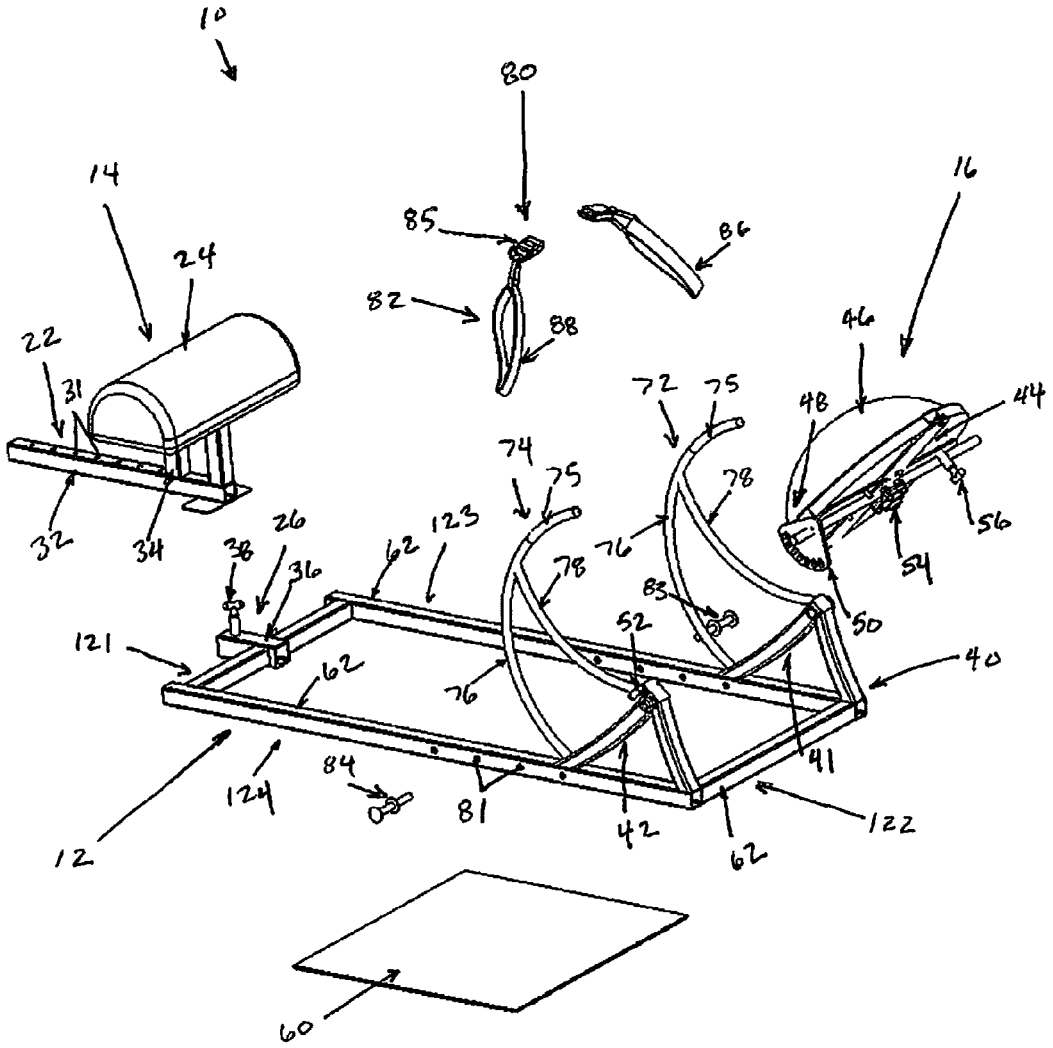
FIG. 13 is an exploded perspective assembly view of the exercise machine of FIGS. 1-5.

In alternative embodiments, as illustrated in FIG. 7 of the present disclosure, the support plate 44, along with the engagement member 46, of the foot support 16 may be coupled statically to the mount bracket 40. In such embodiments, the pivot lock 48 is omitted since the support plate 44 is not coupled for movement about an axis 44A.

Figure 5:
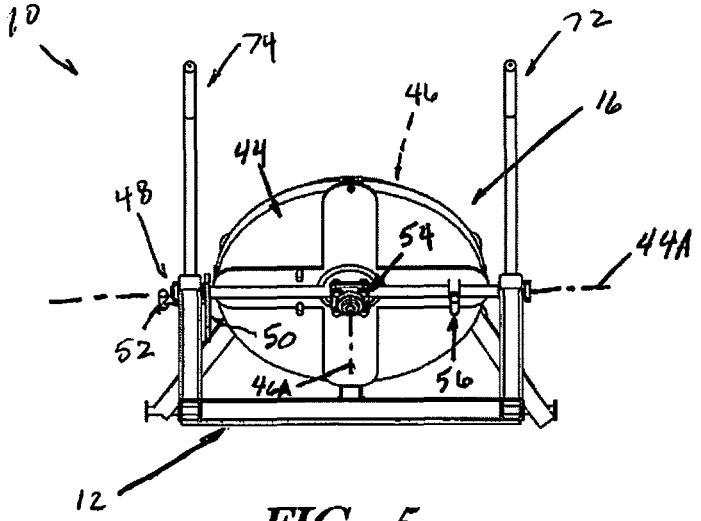
FIG. 5 is a foot end elevation of the exercise machine of FIGS. 1-3 with a foot support having rotational devices.

In the illustrative embodiment, the engagement member 46 of the foot support 16 is coupled to the support plate 44 for rotation about a rotation axis 46A relative to the support plate 44 as shown in FIGS. 1 and 2. The rotation axis 46A or X-axis extends substantially perpendicular to a plane defined by the support plate 44. The foot support of the exemplary embodiment includes a rotation bearing 54 that supports the engagement member 46 for rotation about the rotation axis 46A and a rotation lock 56 that selectively blocks or allows rotation about the rotation axis 46A as shown in FIG. 5. The rotation lock 56 includes a pin 58 that moves into and out of engagement with the engagement member 46 to block or allow rotation about the rotation axis 46A.

Figure 6:
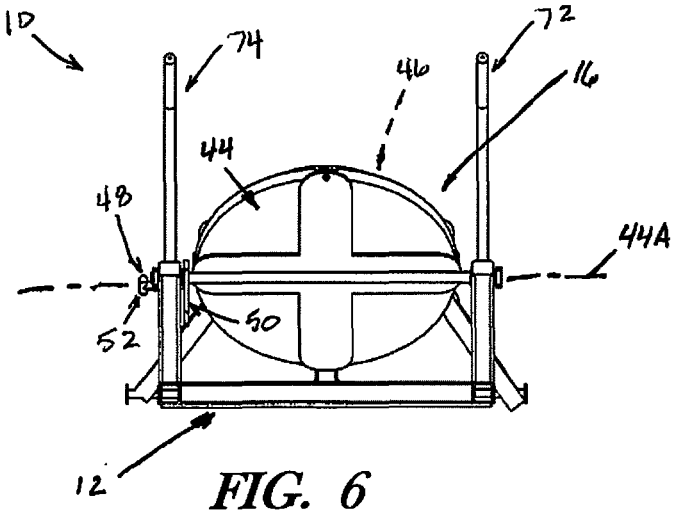
FIG. 6 is a foot end elevation of the exercise machine of FIGS. 1-3 with an alternative foot support having rotational devices.

In alternative embodiments, as illustrated in FIGS. 6 and 7 of the present disclosure, the engagement member 46 of the foot support 16 may be coupled statically to the support plate 44. In such embodiments, the rotation bearing 54 and the rotation lock 56 are omitted since the engagement member 46 is not mounted for rotation about an axis 46A.

In the illustrative embodiment, the engagement member 46 is an elastic, deformable component configured to deform in response to a user applying body weight to the engagement member 46 as suggested in FIGS. 1 and 2. More specifically, the engagement member 46 is configured to deform in response to engagement by the feet of the user such that the feet of the user rotate about an engagement axis 45A when the user shifts weight from one foot to the other during exercise while supported on the foot support 16. The engagement axis 45A or Z-Axis is generally parallel to a plane defined by the support plate 44.

In the illustrative embodiment, the engagement member 46 has a curved dome shape that encourages stabilizer muscles of a user to be engaged when balancing on the foot support 16 as suggested in FIGS. 10 and 12. The curved dome shape of the engagement member 46 is optional and may be replaced by another shape or multiple foot supports. The curved dome engagement member 46 in the exemplary embodiment is provided by an inflated portion of a balance or Bosu™ ball. In other embodiments, a shaped pad or other suitable deformable and/or non-deformable materials may be used to provide the curved dome engagement member 46.

In alternative embodiments, the engagement member 46 may be rigid and non-deformable. In such embodiments, the engagement member 46 would not deform when the user shifts weight from one foot to the other during exercise while supported on the foot support 16.

In the illustrative embodiment, the support plate 44 has a cross or +-shape as shown in FIGS. 5-7. In other embodiments, the support plate 44 may have a shape corresponding to the engagement member (i.e. round) sized to support a user's feet. In some embodiments, the engagement member 46 may be removable or omitted and the feet of a user may engage the support plate 44 directly so that movement about engagement axis 45A or Z-Axis is avoided as may be desired by the user.

The base frame 12 illustratively includes a base plate 60 and a plurality of frame tubes 62 as shown in FIGS. 1 and 2. The base plate 60 is coupled to and underlies the frame tubes 62. The frame tubes 62 illustratively form a rectangular shape and generally define a footprint of the exercise machine 10.

The exercise machine 10 shown includes left and right handles 72, 74 adapted to provide a hand grip for users entering and exiting the exercise machine 10 as shown in FIGS. 1 and 2. The left and right handles 72, 74 each extend along a corresponding left or right side 123, 124 of the base frame 12 from a corresponding one of the risers 41, 42 included in the mount bracket 40 of the foot support 16. Each of the handles 72, 74 are generally arcuate and include an arcuate arm 76 that provides a cantilevered grip portion 75 and an arcuate support strut 78 that extends from the mount bracket 40 to the arm 76 to reinforce the arm 76.

The resistance mechanism 80 illustratively included in the exercise machine 10 shown in FIGS. 1 and 2 includes a resistance band 82. The resistance band 82 is configured to resist movement of the hips of the user from the lowered position within the exercise space below the elbows and feet of the user to the raised position above the elbows and feet of the user when performing the hip thrust movement. The resistance band 82 is coupled to the base frame 12 via pegs 83, 84 and is arranged to extend over the base frame 12 between the head end 121 and the foot end 122 of the base frame 12.

The resistance band 82 includes a first elastic portion 86 coupled to the left side 123 of the base frame 12, a second elastic portion 88 coupled to the right side 124 of the base frame 12, and a buckle 85 configured to couple the first elastic portion 84 to the second elastic portion 86 after a user has entered the exercise area 15. The resistance band 82 is effectively elastic and provides progressive resistance that increases as a user performs a hip thrust exercise. Further, the position of the resistance band 82 along the base frame 12 is adjustable via spaced apart holes 81 formed in the base frame 12 that receive the pegs 83, 84.

An alternative exercise machine 210 in accordance with the present disclosure is shown in FIGS. 14-21. The exercise machine 210 is substantially similar to exercise machine 10 as indicated by similar reference numbers shown in the included drawings. Accordingly, the description of exercise machine 10 is incorporated herein by reference to apply to exercise machine 210, except as it conflicts with the following description and the drawings.

Figure 14:
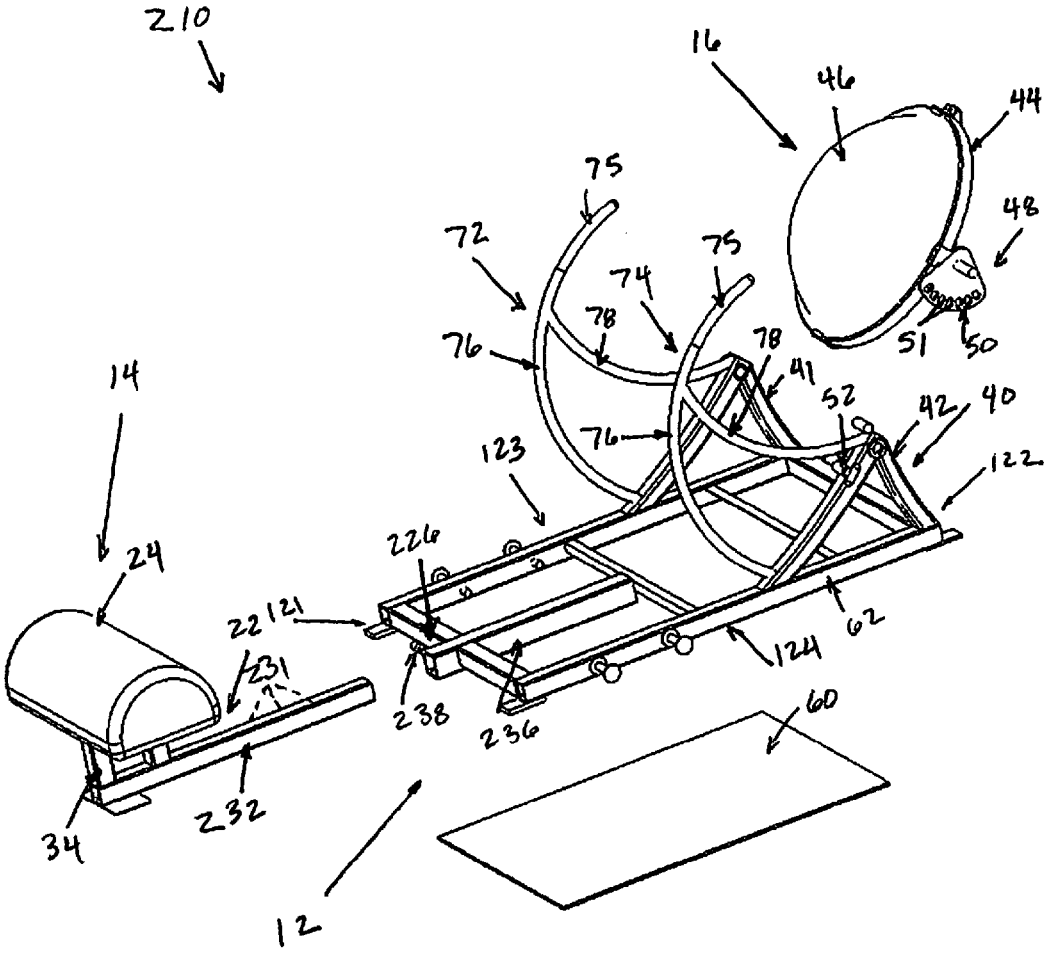
FIG. 14 is an alternative exercise machine according to the present disclosure that is similar to the exercise machine of FIGS. 1-13.

Unlike the exercise machine 10, the exercise machine 210 includes a horizontally extending portion 232 of the riser 22 included in the head support 14 that extends toward the foot end 122 of the base frame 12 as shown in FIG. 14. Correspondingly, a lock 226 included in the head support 14 includes a receiver 236 sized and arranged to receive the horizontally extending portion 232 and a pin 238 arranged to engage horizontally oriented holes 231 formed in the portion 232 as suggested in FIG. 14.

Another resistance mechanism 280 is shown incorporated into the exercise machine 210 in FIGS. 15-21. The resistance mechanism 280, sometimes called an accessory side bar resistance system, is configured to resist movement of the hips of the user from the lowered position within the exercise space below the elbows and feet of the user to the raised position above the elbows and feet of the user when performing the hip thrust movement. The resistance mechanism 280 may be used in place of or in addition to the resistance mechanism 80 with the exercise machines 10, 210.

Figure 15:
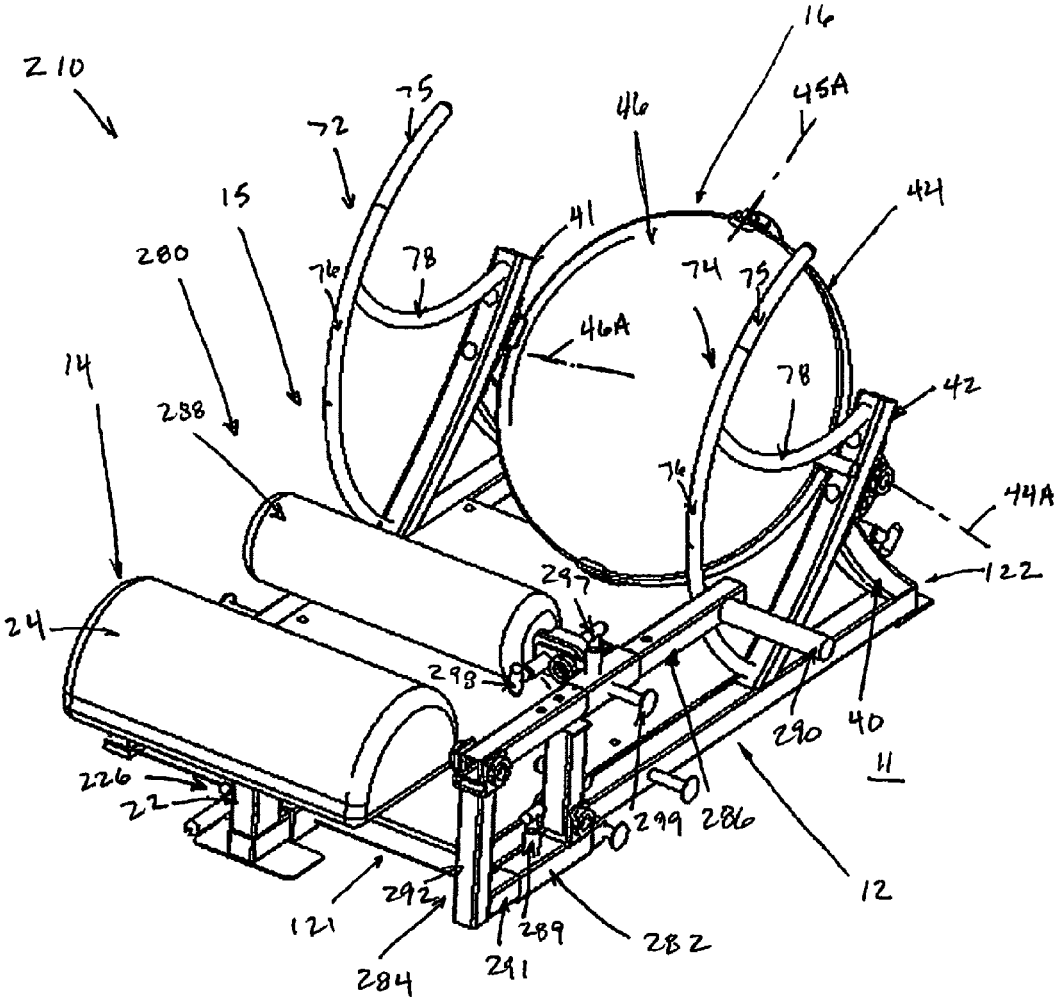
FIG. 15 is a head end perspective view of the exercise machine of FIG. 14 showing an optional accessory side bar resistance system included in the apparatus.

The resistance mechanism 280 illustratively includes a coupler 282, a riser 284, a pivot bar 286, and a hip bar 288 as shown in FIG. 15. The coupler 282 is adapted to selectively couple to the base frame 12. The riser 284 extends upwardly from the coupler 282. The pivot bar 286 is coupled to the riser to pivot relative to the riser 284 when the hip bar 288 is moved. The hip bar 288 is arranged to be directly engaged by a users hips and is adapted to be lifted by a user performing a hip thrust on the exercise machine 210.

Figure 16:
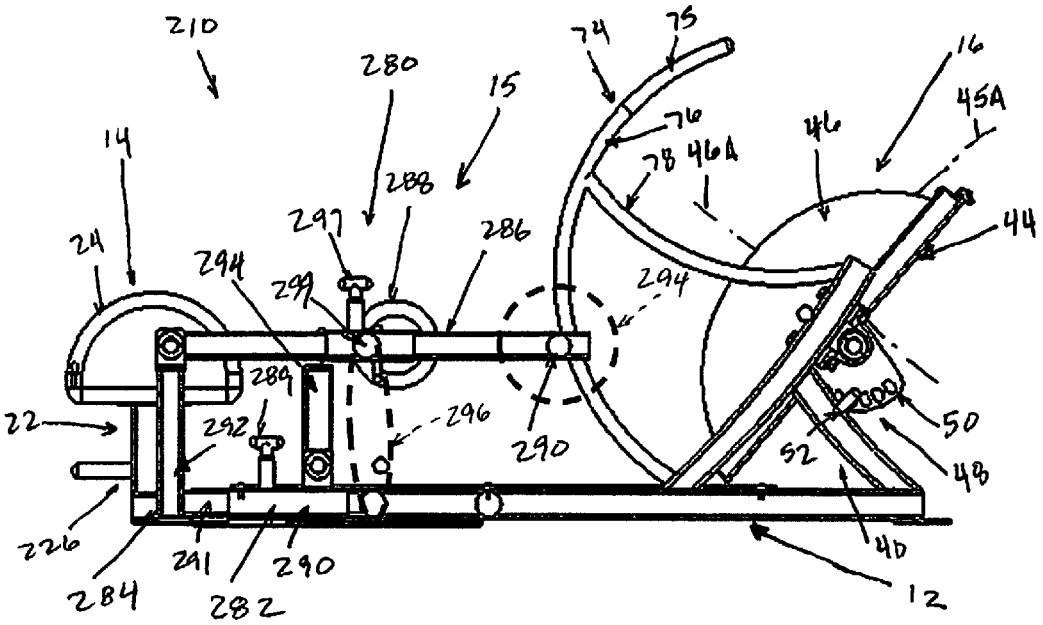
FIG. 16 is a side elevation view of the exercise machine of FIG. 15 suggesting that plate weights and/or resistance bands may be used with the accessory side bar resistance system to load a user exercising on the exercise machine.
Figure 17:
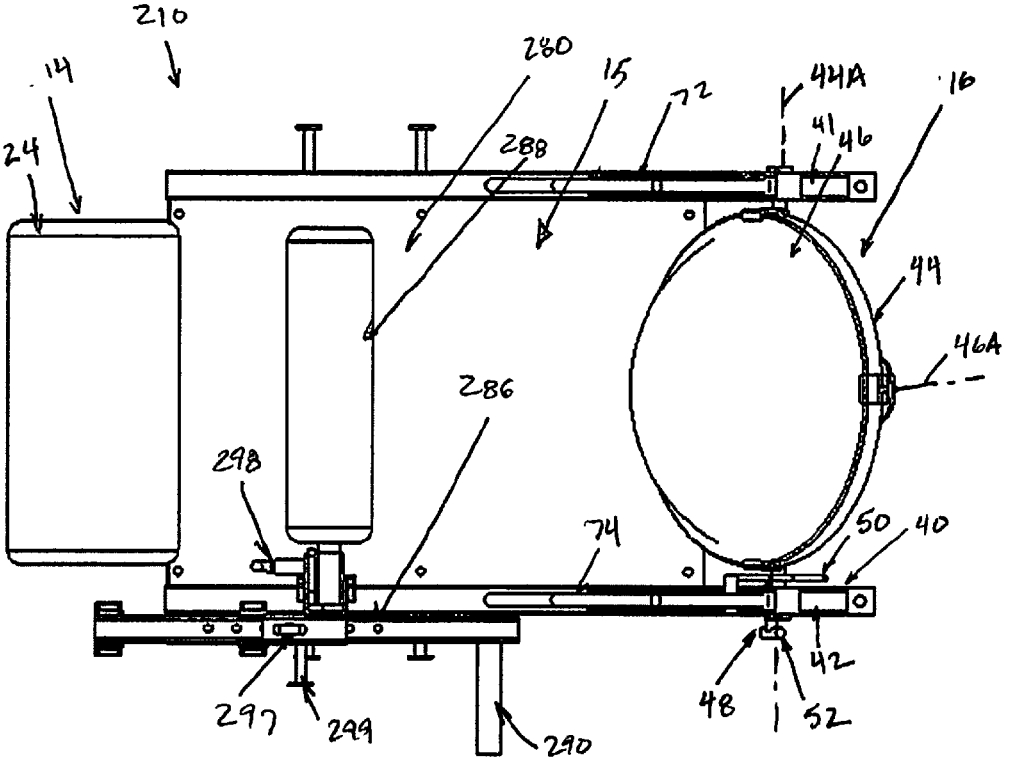
FIG. 17 is a top plan view of the exercise machine of FIGS. 15 and 16.
Figure 18:
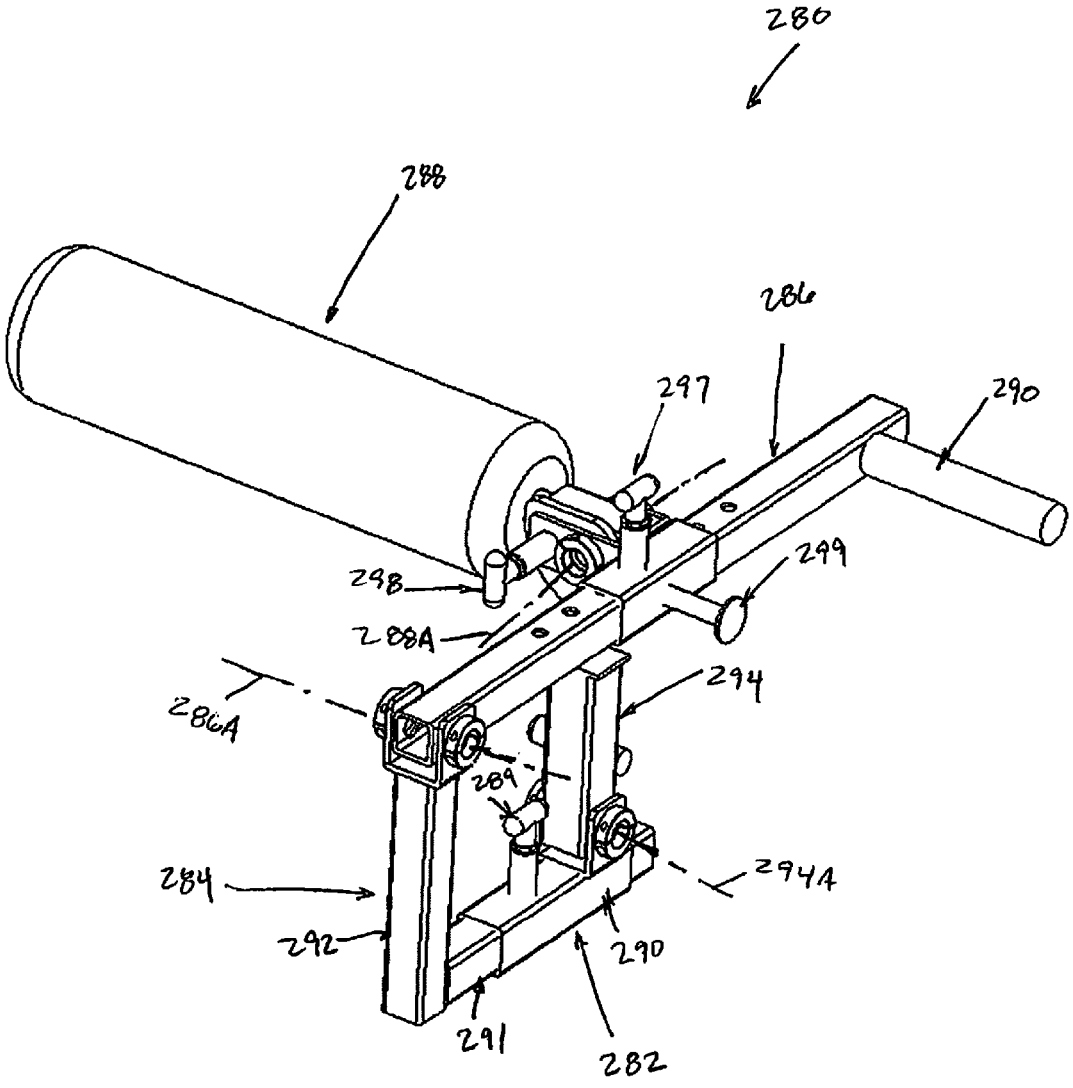
FIG. 18 is a perspective view of the accessory side bar resistance system of FIGS. 15-17.
Figure 19:
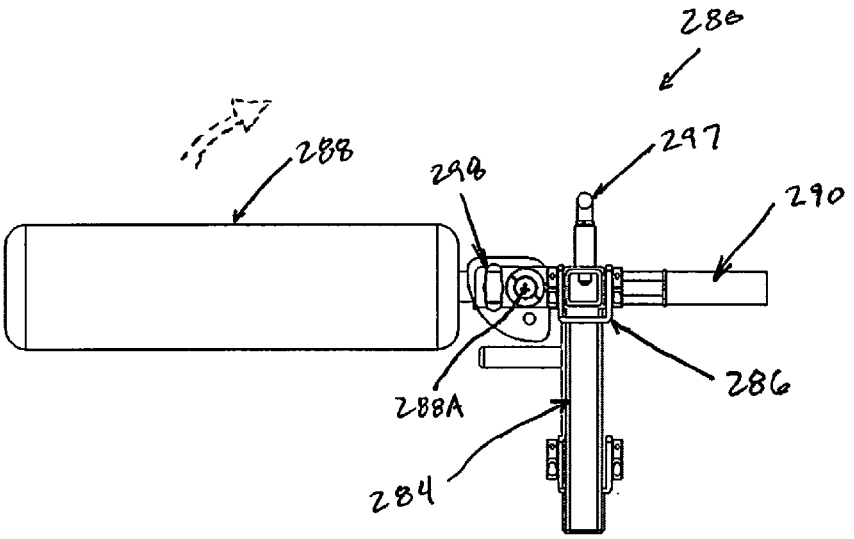
FIG. 19 is a head end elevation view of the accessory side bar resistance system in a use position arranged to extend over a user supported on the exercise machine of FIGS. 15-18.
Figure 20:
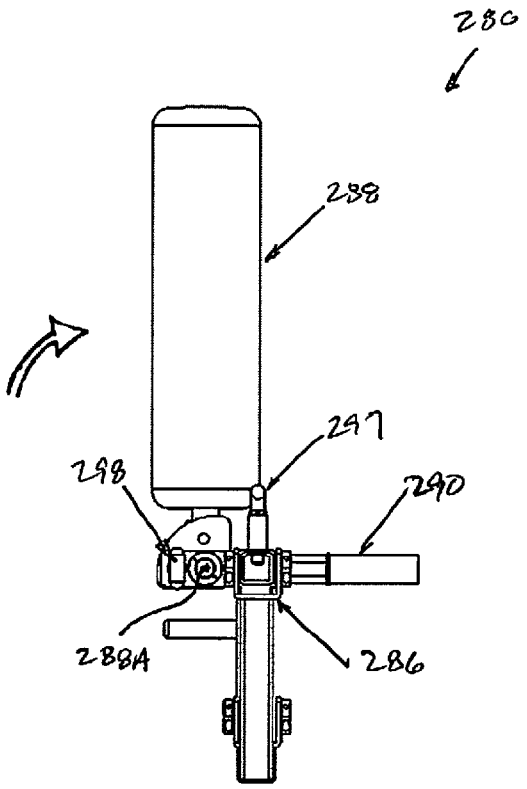
FIG. 20 is a head end elevation view of the accessory side bar resistance system in an entry/exit position arranged to extend upwardly to allow a user to enter or exit the exercise machine of FIGS. 15-18 without sliding under the accessory side bar resistance system.

The coupler 282 of the mechanism 280 selectively allows the riser 284 to slide toward and away from the foot end 122 of the base frame 12 to accommodate differently sized users as suggested in FIGS. 15-17. The coupler includes a receiver 290 that slidably receives the riser 284, a lock screw 293 that may be rotated to selectively block or allow this sliding of the riser 284 within the receiver 290, and a pivot bar rest 294. The receiver 290 is coupled to the base frame 12. The pivot bar rest 294 extends upwardly from the coupler and blocks the pivot bar 286 and hip bar 288 from movement below a predetermined position. The pivot bar rest 294 may be rotated about an axis 294A relative to the receiver 290 to allow the pivot bar 286 to move downwardly past horizontal during use as desired.

The riser 284 of the mechanism 280 is illustratively L-shaped having a horizontally extending leg 291 and a vertically extending leg 292 as shown in FIG. 15. The horizontally extending leg 291 is slidably received in the coupler 282 and is engaged by the lock screw 289 to selectively block sliding of the riser 284. The vertically extending leg 292 is pivotably coupled to the pivot arm 286 to support the pivot arm 286 for movement about an axis 286A.

The pivot arm 286 is mounted to pivot about the axis 286A when a user lifts upwardly on the hip bar 288 as suggested in FIGS. 15-17. A weight plate pin 290 extends from the pivot arm 286 away from the base frame 12 and is configured to support standard plate weights 294 as suggested in phantom in FIG. 16 to exert constant loading on a user during exercise on exercise machine 10. In addition, a retention pin 299 extends from pivot arm 286 away from the base frame 12 and is configured to retain an elastic band 296 coupled to the pivot arm 286 as suggested in phantom in FIG. 16. Elastic bands 296 may extend from the pivot bar 286 to the coupler 282 or the base frame 12 to provide increasing load in addition to (or in place of) the constant load applied by the plate weights 294.

The hip bar 288 is mounted to pivot bar 286 for movement therewith about axis 286A when the hip bar 288 is lifted upwardly by a user exercising. The hip bar 288 is coupled to the pivot bar 286 to slide along the pivot bar 286 to accommodate users of various shapes. A lock 297 (illustratively a pin lock) is configured to selectively block or allow sliding of the hip bar 288.

The hip bar 288 is also coupled to the pivot bar 286 for movement relative to the pivot bar 286 from a use position arranged extend horizontally over the exercise space 15 to an entry/exit position arranged to extend upwardly/vertically along the exercise space 15 to allow a user to enter or exit the exercise space 15. A lock 298 (illustratively a pin lock) is configured to selectively block or allow pivoting movement of the hip bar 288 about an axis 288A between the use position and the entry/exit position.

Figure 21:
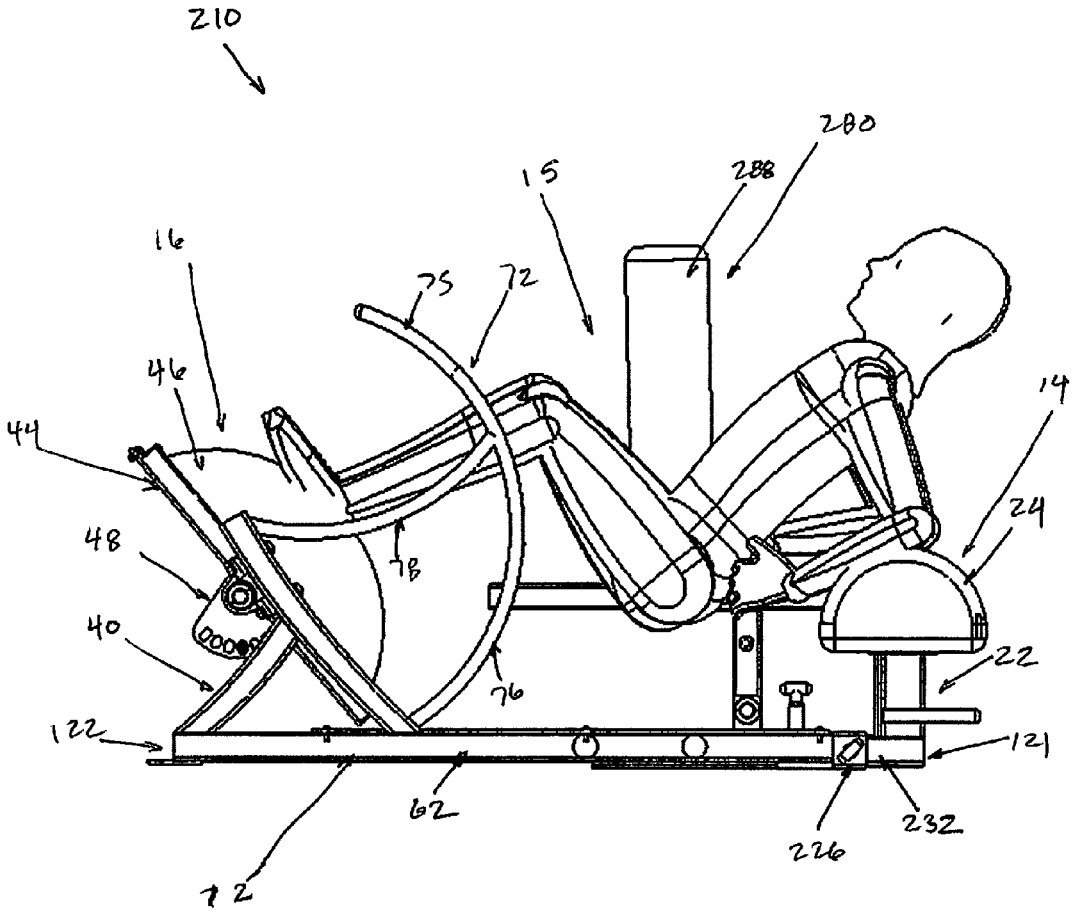
FIG. 21 is a side elevation view of the exercise machine of FIGS. 15-17 showing a user supported on the exercise machine.

According to one method of using the disclosed exercise machine 10, a user places her elbows on the head support 14 keeping her back spaced apart from the head support 14 as shown in FIGS. 10, 12, and 21. The user then places both feet on the foot support 16 so that the hips of the user are suspended in the exercise space 15 between the head support 14 and the foot support 16. The user then moves her hips from a lowered position within the exercise space 15 below the elbows and feet of the user to a raised position above the elbows and feet of the user to perform a hip thrust movement. In addition to the steps described above, the user may adjust the head support 14, foot support 16, and/or resistance mechanisms 80, 280 as suggested in the foregoing description before moving her hips so that the exercise machine 10 is suitably configured for her particular body size.

There have been pieces of exercise equipment adapted to isolate particular muscles groups of the legs. Such equipment sometimes only allows freedom in movement in the Y (pitch) axis at the foot location. Equipment according to the present disclosure can allow freedom of rotation in the X (roll) and Z (yaw) axis. This freedom allows several more muscle groups to be engaged and therefore strengthened at a faster rate than if there was no or little freedom to rotate. By working these other muscle groups in the lower leg and foot regions, this expands benefits for agility and speed enhancements. This is due to better foot control and ability to work together with the upper leg as a system versus an individual component for directional control and speed of the body. Other equipment can also require the user to dismount from equipment by removing bar bells, plate weight, removing body belts or disconnecting a band far off to one side which is not always easy for users to access. Since the user must move from a vertical to horizontal position and back again, this disclosed device can include hand rails that assist the user to mount and dismount into and out of the equipment.

The teachings of the present disclosure provide machines 10, 210 that exercise the gluteal muscle group to be fully engaged without applying compressive loading on the spine. When the user is in position facing in an upward direction, the feet are placed on a pivotal (Y and Z axis) spherical dome. To counteract this freedom of motion, the user must exert forces to resist and thereby engage the intended muscle groups. The user then lifts the hip in a upward movement engaging several muscle groups in the posterior upper legs, posterior lower legs such as; gluteus maximus-meduis-minimus, bicep femoris, semimembrancosus, plantaris, solues, gastrocnemius, flexor digitorium, peroneus longus, tibialis anterior, extensor digitorium longus, peroneus brevis and peroneus longus.

The teachings of the present disclosure allow development of the lower foot control muscles to strengthen by virtue of the freedom of rotation of the feet due to utilizing the roll and yaw axis. Since the feet are free to pivot in the roll and yaw planes, this forces engagement of the controlling muscle groups of the foot and ankle, therefore working and strengthening those muscle groups. The other muscle groups that are targeted due to the freedom of the roll and pitch axis movement is the foot control muscles and tendons such as: superior extensor retinaculum, inferior extensor retinaculum, extensor digitorum, brevis extensor halluces brevis, flexor digitorum longus, calcanel tendon, plantar aponuerosis, adductor digiti minimi, flexor digitorium brevis, flexor digiti minimi, brevis adductor halluces. These axis are able to pivot by various methods: compression and decompression of an inflatable half or full ball, pivoting axle, pivoting planes, etc. This is allows users to equalize the strength on either side of the body evenly. This can improve performance movements such a stride speed and body agility.

The teachings of the present disclosure allow mounting and dismounting to be quick simple and adjust the preload of the resistance bands. By having multiple sets of bands on either side of the user, this allows the user to attach the resistance bands at the centerline of the equipment. The user is able to add external resistance besides body weight by an attachment mechanism that is connected with sets of resistance bands on either side of the body. This quick release mechanism can be connected by: Velcro™ magnet, pin and hole, hook and hole, hook and loop, knot, tab and slot or other latching types of methods. The center connection, meaning between the sets of bands, allows the user to quickly and easily get mounted and dismounted into the equipment when using resistance.

The exercise machines disclosed herein allows for a comprehensive workout for the user to experience. By duplicating a more realistic load and movement profile on the disclosed machines machine, one may be able to strengthen the intended body parts to allow for better performance in a functional sport or real world movement.

The exercise machines of the present disclosure may allow setting a preload of the resistance bands. The preload is set by the user to tighten the quick release mechanism by lengthening or shortening the distance of the strap or connector to adjust when the load will begin to add resistance on the user. This gives the user more adjustability and allows better focus on the targeted muscle groups. This happens by fine tuning the start and finish locations of the resistance thru the range of movement. This is important since each user's strength level is different and each user's flexibility is unique. By having this adjustment, it will allow the user to incrementally change the resistance initiation point and therefore customize the strength to their specific needs.

Although certain illustrative embodiments have been described in detail above, variations and modifications exist within the scope and spirit of this disclosure as described and as defined in the following claims.

The invention claimed is:

1. A hip thrust exercise machine comprising a base frame adapted to be supported on a floor, the base frame having a head end and a foot end spaced apart from the head end, a head support coupled to the base frame at the head end of the base frame and adapted to support elbows of a user above the base frame, and a foot support spaced from the head support and coupled to the base frame at the foot end of the base frame to define an exercise space between the head support and the foot support, the foot support adapted to support feet of the user above the base frame so that hips of a user may be moved from a lowered position within the exercise space below the elbows and feet of the user to a raised position above the elbows and feet of the user to perform a hip thrust movement, and the foot support including a mount bracket that extends upwardly from the base frame, a support plate coupled to the mount bracket, and a curved spherical dome coupled to the support plate to provide a foot engagement surface arranged to support the feet of the user, wherein the curved spherical dome is sized and arranged to extend over a side of the support plate such that the curved spherical dome provides the foot engagement surface configured to be directly engaged by the feet of the user.

2. The exercise machine of claim 1, wherein the support plate and the curved spherical dome of the foot support are coupled to the mount bracket to pivot relative to the mount bracket about a pivot axis that extends perpendicular to an axis of the base frame that extends from the head end to the foot end of the base frame.

3. The exercise machine of claim 2, wherein the foot support includes a pivot lock configured to block or allow movement of the support plate and the curved spherical dome of the foot support about the pivot axis relative to the mount bracket of the foot support.

4. The exercise machine of claim 1, wherein the head support includes a riser coupled to the base frame to slide relative to the base frame toward and away from the foot end of the base frame, a head pad coupled to the riser above the base frame for movement with the riser, and a slide lock configured to selectively block or allow movement of the riser and the head pad relative to the base frame.

5. The exercise machine of claim 1, further comprising at least one handle that extends from the mount bracket of the foot support toward the head support to provide a hand grip for a user entering or exiting the exercise machine.

6. The exercise machine of claim 1, further comprising a resistance mechanism configured to resist movement of the hips of the user from the lowered position within the exercise space below the elbows and feet of the user to the raised position above the elbows and feet of the user when performing the hip thrust movement.

7. The exercise machine of claim 6, wherein the resistance mechanism includes a resistance band coupled to the base frame and arranged to extend over the base frame between the head end and the foot end of the base frame.

8. The exercise machine of claim 7, wherein the resistance band includes a first elastic portion coupled to a left side of the base frame, a second elastic portion coupled to a right side of the base frame, and a coupler mechanism configured to couple the first elastic portion to the second elastic portion.

9. The exercise machine of claim 6, wherein the resistance mechanism includes a hip bar mounted in a use position to extend over the base frame through the exercise space between the head end and the foot end of the base frame and configured to move relative to the base frame when lifted by the hips of the user.

10. The exercise machine of claim 9, wherein the resistance mechanism includes a weight plate pin coupled to the hip bar for movement therewith arranged to extend away from the base frame and sized to plate weights.

11. The exercise machine of claim 10, wherein the hip bar is mounted to pivot from the use position to an entry/exit position in which the hip bar extends upwardly along the exercise space to allow a user to enter or exit the exercise space.

12. A hip thrust exercise machine comprising a base frame adapted to be supported on a floor, the base frame having a head end and a foot end spaced apart from the head end, a head support coupled to the base frame at the head end of the base frame and adapted to support elbows of a user above the base frame, and a foot support spaced from the head support and coupled to the base frame at the foot end of the base frame to define an exercise space between the head support and the foot support, the foot support adapted to support feet of the user above the base frame so that hips of a user may be moved from a lowered position within the exercise space below the elbows and feet of the user to a raised position above the elbows and feet of the user to perform a hip thrust movement, and the foot support including a mount bracket that extends upwardly from the base frame, a support plate coupled to the mount bracket, and a curved dome coupled to the support plate to provide a foot engagement surface arranged to support the feet of the user, wherein the curved dome is coupled to the support plate to rotate relative to the support plate about a rotation axis that extends substantially perpendicular to a plane defined by the support plate.

13. The exercise machine of claim 12, wherein the support plate and the curved dome of the foot support are coupled to the mount bracket to pivot relative to the mount bracket about a pivot axis that extends perpendicular to an axis of the base frame that extends from the head end to the foot end of the base frame.

14. The exercise machine of claim 13, wherein the curved dome is elastic and is configured to deform in response to engagement by the feet of the user such that the feet of the user rotate about an engagement axis generally parallel to the plane defined by the support plate when the user shifts weight from one foot to the other during exercise while supported on the foot support.

15. A hip thrust exercise machine comprising a base frame adapted to be supported on a floor, the base frame having a head end and a foot end spaced apart from the head end, a head support coupled to the base frame at the head end of the base frame, the head support including a riser that extends upwardly from, and a foot support spaced from the head support and coupled to the base frame at the foot end of the base frame to define an exercise space between the head support and the foot support, the foot support including a mount bracket that extends upwardly from the base frame, a support plate coupled to the mount bracket to pivot relative to the mount bracket about a pivot axis that extends perpendicular to an axis of the base frame that extends from the head end to the foot end of the base frame, and a lock configured to selectively block or allow the support plate to pivot relative to the mount bracket about a pivot axis, wherein the foot support includes an engagement member coupled to the support plate to move with the support plate about the pivot axis and to rotate relative to the support plate about a rotation axis that extends substantially perpendicular to a plane defined by the support plate.

16. The exercise machine of claim 15, wherein the engagement member is an elastic, deformable component configured to deform in response to a user applying body weight to the engagement member.

17. The exercise machine of claim 15, further comprising a resistance mechanism configured to resist movement of the hips of the user from the lowered position within the exercise space below the elbows and feet of the user to the raised position above the elbows and feet of the user when performing the hip thrust movement.

18. The exercise machine of claim 17, wherein the resistance mechanism includes a resistance band coupled to the base frame and arranged to extend over the base frame between the head end and the foot end of the base frame and the resistance band is configured to stretch elastically.

19. The exercise machine of claim 17, wherein the resistance mechanism includes a hip bar mounted to extend from along a first side of the base frame toward a second side of the base frame, opposite the first side, and a weight plate pin sized to plate weights that is coupled to the hip bar for movement therewith.

* * * * *